US011621115B2

(12) United States Patent
Schumm et al.

(10) Patent No.: US 11,621,115 B2
(45) Date of Patent: Apr. 4, 2023

(54) METHOD FOR ASSEMBLING A MAGNETIC CORE FOR A TRANSFORMER

(71) Applicant: BorgWarner Ludwigsburg GmbH, Ludwigsburg (DE)

(72) Inventors: Sven Schumm, Walheim (DE); Manfred Adolf, Schwaikheim (DE); Manuel Bauer, Ludwigsburg (DE); Alexander Stark, Althengstett (DE); Timo Stifel, Stuttgart (DE); Dirk Wüstenhagen, Auma (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 576 days.

(21) Appl. No.: 16/412,164

(22) Filed: May 14, 2019

(65) Prior Publication Data

US 2019/0362882 A1 Nov. 28, 2019

(30) Foreign Application Priority Data

May 22, 2018 (DE) ..... 10 2018 112 245.4

(51) Int. Cl.
*H01F 7/06* (2006.01)
*H01F 27/26* (2006.01)
(Continued)

(52) U.S. Cl.
CPC ..... *H01F 27/263* (2013.01); *H01F 27/266* (2013.01); *H01F 27/28* (2013.01); *H01F 41/0233* (2013.01)

(58) Field of Classification Search
CPC .... H01F 27/245; H01F 27/266; H01F 27/263; H01F 27/28; H01F 38/12; H01F 41/0233; H01F 2038/127
See application file for complete search history.

(56) References Cited

U.S. PATENT DOCUMENTS 4,990,881 A 2/1991 Ooyabu
5,285,761 A 2/1994 Hancock et al.
(Continued)

FOREIGN PATENT DOCUMENTS

CN 1094481 A 11/1994
CN 101015027 A 8/2007
(Continued)

OTHER PUBLICATIONS

Laminations for Transformers and Inductors—Part 1: Mechanical and Electrical Characteristics (IEC 60740-1:2005); German version DIN EN 60740-1:2005, DKE German Commission for Electrical Engineering Electronics, German Institute for Standardization, May 2006, 60 pages.

*Primary Examiner* — Paul D Kim
(74) *Attorney, Agent, or Firm* — Bose McKinney & Evans LLP

(57) ABSTRACT

A method is described for the assembly of a magnetic core for a transformer, with the following steps: Cutting sheet metal blanks from transformer sheet, stacking the sheet metal blanks to form magnetic core segments, placing a permanent magnet at one of the magnetic core segments so that the latter is magnetized by the permanent magnet, formation of the magnetic core by placing the remaining magnetic core segments against the permanent magnet, or against a magnetic core segment already magnetized by the permanent magnet. A magnetic core is also disclosed.

11 Claims, 5 Drawing Sheets

(51) Int. Cl.
*H01F 27/28* (2006.01)
*H01F 41/02* (2006.01)

(56) References Cited

U.S. PATENT DOCUMENTS

| | | | | | |
|---|---|---|---|---|---|
| 5,349,320 | A * | 9/1994 | Suzuki | H01F 27/02 | 336/107 |
| 5,685,065 | A * | 11/1997 | Suzuki | H01F 38/12 | 123/634 |
| 5,821,844 | A * | 10/1998 | Tominaga | H01F 29/146 | 336/110 |
| 2011/0032069 | A1 | 2/2011 | Navarro et al. | | |
| 2011/0304419 | A1 * | 12/2011 | Dal Re | H01F 3/14 | 335/297 |

FOREIGN PATENT DOCUMENTS

| | | | |
|---|---|---|---|
| DE | 1 273 084 | B | 7/1968 |
| DE | 689 06 607 | T2 | 10/1993 |
| WO | WO 2005/104145 | A2 | 11/2005 |

* cited by examiner

METHOD FOR ASSEMBLING A MAGNETIC CORE FOR A TRANSFORMER

RELATED APPLICATIONS

This application claims priority to DE 10 2018 112 245.4, filed May 22, 2018, the entire disclosure of which is hereby incorporated herein by reference.

BACKGROUND

This disclosure refers to a method for the assembly of a laminated magnetic core for a transformer. The assembly of a magnetic core is sometimes also referred to as the production of a magnetic core.

Transformers contain a magnetic core that forms a magnetic circuit. Magnetic cores are usually composed of a plurality of soft iron parts referred to as core segments, for example of one I-piece and one C-piece, two L-pieces or four I-pieces. When assembling the various core segments, care must be taken to avoid air gaps as far as possible, since an air gap significantly reduces the efficiency of the transformer. The individual parts or segments of a magnetic core are formed from layered transformer sheets. Such magnetic cores are referred to as laminated magnetic cores, because they consist of stacks of metal sheets.

DE 1 273 084 discloses a laminated magnetic core, which is assembled from four I-pieces, namely two longitudinal legs and two transverse legs. The individual legs are in each case stacks of layered transformer sheets and in each case face towards an end face of a longitudinal side of an adjacent leg. Moving the legs relative to each other can thus compensate for manufacturing tolerances, and an air gap can thus be avoided. However, the handling of the stacks consisting of sheet metal strips during assembly is laborious and time-consuming.

This effort can be avoided by reducing the number of core segments, for example by combining a C-shaped core segment with an I-shaped core segment. However, in practice an air gap in the magnetic circuit due to manufacturing tolerances cannot then be avoided.

SUMMARY

This disclosure shows how a laminated magnetic core for an ignition coil that is free of air gaps can be created cost-efficient.

According to this disclosure, a permanent magnet is used to hold the sheet metal stacks of the individual core segments together during the production of the magnetic core. By placing the permanent magnet against a first sheet metal stack forming a core segment, this sheet metal stack is magnetized and from then on is held together by magnetic force. A further sheet metal stack, which forms a further core segment, is then placed at the permanent magnet, or the already magnetized sheet metal stack. By this means the further sheet metal stack is also magnetized and from then on is held together by magnetic force, and held on the part of the core thus formed. Subsequently, further sheet metal stacks are abutted against the permanent magnet, or against one of the already magnetized sheet metal stacks, and by this means are similarly magnetized until the magnetic core is closed.

In accordance with this disclosure, a permanent magnet is thus used as an assembly aid. The permanent magnet magnetizes the sheet metal stacks abutted against it, together with the sheet metal stacks adjacent to sheet metal stacks that are already magnetized, so that a solid, easy-to-handle assemblage is created. By this means the assembly of the magnetic core is considerably simplified, as is the further assembly, in particular, of a transformer containing the magnetic core.

Permanent magnets are sometimes used in conventional magnetic cores to improve the efficiency of the transformer. To simplify assembly, however, a magnetic action is not required when using the magnetic core in a transformer. In accordance with this disclosure, therefore, low-cost permanent magnets, such as ferrite magnets, whose magnetic action is not required in operation, are preferably used, for example permanent magnets with a Curie temperature below the permissible operating temperature of the transformer in which the magnetic core is used. If the Curie temperature of the permanent magnet used is exceeded under operating conditions of the transformer, its magnetic force disappears.

This disclosure can be used advantageously, for example, for ignition coils that are used in the vicinity of an engine, and in operation are therefore exposed to considerable thermal loads. In accordance with this disclosure, a magnetic core produced by the inventive method can be used in an ignition coil designed such that in operation the temperature of the magnetic core exceeds the Curie temperature of the permanent magnet.

Ferrite magnets cost significantly less than rare earth magnets, but also have a much lower magnetization and a lower Curie temperature. Ferrite magnets are therefore much less suitable for optimising the efficiency of a magnetic core than rare earth magnets, such as NdFeB magnets. The inferior properties of a cheaper magnet in operation can be compensated for by an appropriate design of the magnet core, in particular by a larger cross-section.

Another advantageous refinement of this disclosure is that the magnetic core segments in each case form one leg of the magnetic core. A magnetic core consisting of four I-shaped core segments is particularly advantageous, because each of the core segments can be cut out in the preferred magnetic orientation of the transformer sheet.

In order to utilize the advantages of a permanent magnet during assembly, the latter can be positioned anywhere on a stack of metal sheets. However, the permanent magnet is preferably a disk that is positioned on one end face of a stack of metal sheets, that is to say, it sits between two core segments in the finished magnetic core.

In one embodiment, the inventive magnetic core has two longitudinal legs and two transverse legs made from laminated transformer sheets. A permanent magnet is arranged between a first longitudinal leg and a first transverse leg. As already explained, this measure simplifies the assembly of the laminated magnetic core considerably. As soon as the permanent magnet is positioned on one of the legs, for example on the end face of the first longitudinal leg, the stack of laminated sheet metal blanks forming this leg is held together by magnetic force. If further legs are then placed in position, the magnetic force also holds together both the other stacks and also the individual parts of the magnetic circuit, in particular the legs, so that a magnetic circuit that is free of air gaps can be formed with significantly reduced effort.

A magnetic core in accordance with this disclosure is particularly suitable for transformers whose primary and secondary windings are positioned coaxially one above another. Such transformers are widely used in ignition coils.

An advantageous refinement of this disclosure comprises that a first end face of the first longitudinal leg abuts against the permanent magnet, while a second end face abuts against the second transverse leg. This makes possible a more efficient magnetic circuit with a better magnetic coupling of the first longitudinal leg with the two transverse legs than the arrangement of known art from DE 1 273 084.

A magnetic core in accordance with this disclosure is preferably composed of two separate longitudinal legs and two separate transverse legs. However, it is also possible to combine one of the longitudinal legs and one of the transverse legs to form an L-piece and thus form the magnetic core from only two or three, instead of four, soft iron parts.

An advantageous refinement of this disclosure comprises that the first longitudinal leg is widened on its first end face, which abuts against the permanent magnet. The permanent magnet can thus advantageously couple magnetic flux into the first longitudinal leg over a larger surface area. The first longitudinal leg can, for example, be widened on its first end face by making the first longitudinal leg L-shaped. Here it is preferable that the width of the first longitudinal leg in one end section increases continuously towards its first end face.

A further advantageous refinement of this disclosure comprises that the first longitudinal leg has a greater width everywhere than the second longitudinal leg. In this manner, the efficiency of the magnetic circuit can be further improved.

A further advantageous refinement of this disclosure comprises that the two transverse legs are of the same design, and with one end face in each case face towards the second longitudinal leg. Alternatively, it is also possible to use two different transverse legs, wherein one of the two transverse legs abuts against both the end face of the first longitudinal leg and also the end face of the second longitudinal leg, while the other transverse leg abuts against an end face of the first longitudinal leg and a longitudinal side of the second longitudinal leg.

A further advantageous refinement comprises that the interfaces with which the legs abut against each other or against the permanent magnet extend in each case either in the longitudinal direction or in the transverse direction. In this manner, the production of the individual legs can be simplified, since oblique connecting surfaces between the individual legs are avoided.

An inventive magnetic circuit is preferably formed from four individual legs and at least one permanent magnet. Each of the legs can consist of a plurality of overlying metal sheets, or can also be cast in one piece. Here, however, each of the four legs forms a single part or subassembly, which is then connected to the other legs and the at least one permanent magnet during production.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
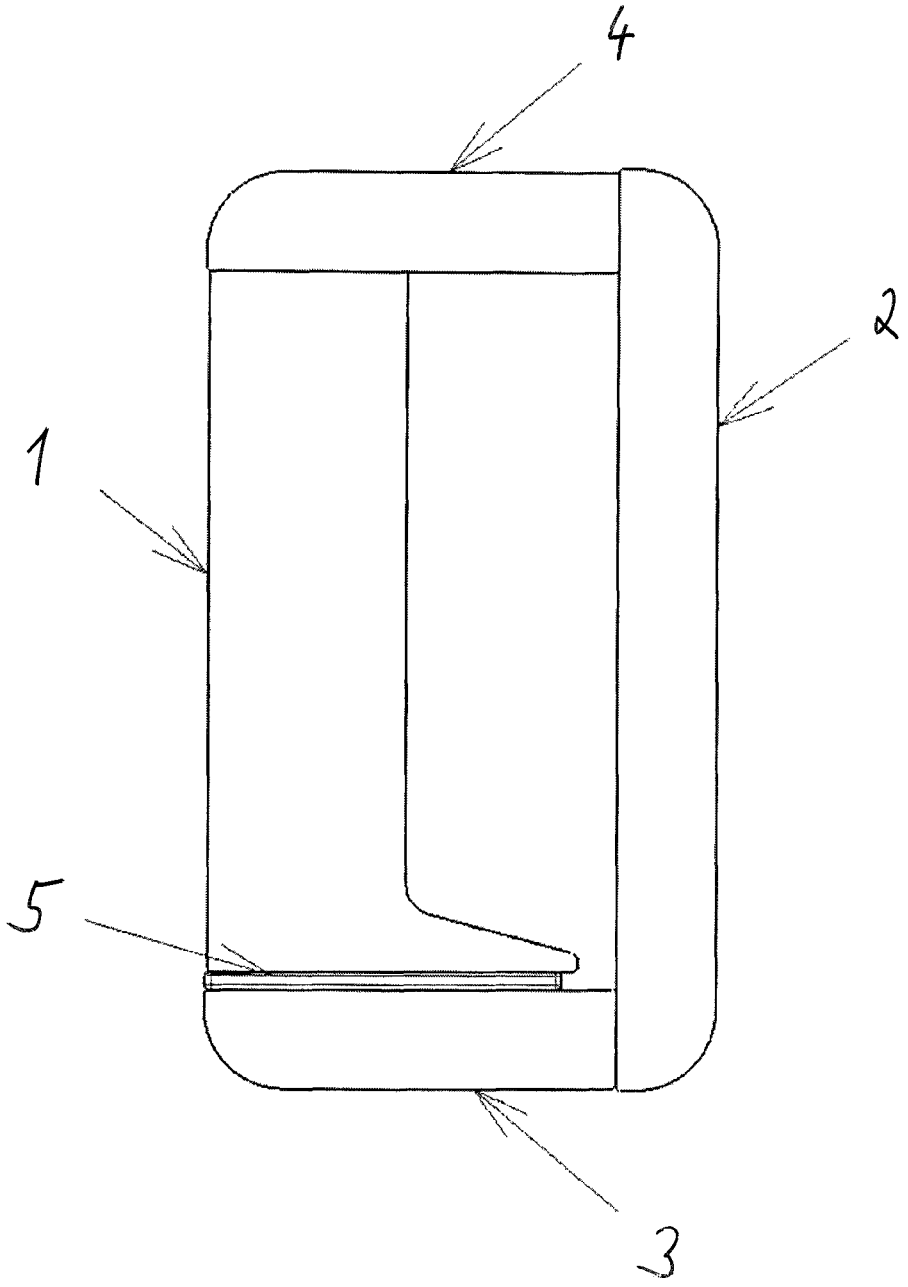
FIG. 1 shows an embodiment of an inventive magnetic core.

FIG. 1 shows a magnetic core for a transformer, for example an ignition coil, which has four separate core segments made of soft iron, namely a first longitudinal leg 1, a second longitudinal leg 2, a first transverse leg 3 and a second transverse leg 4. The legs 1, 2, 3, 4 are formed as stacks of mutually abutting sheet metal blanks. Such stacks are sometimes also referred to as packages.

The magnetic core additionally contains a permanent magnet 5, which is arranged between a first end face of the first longitudinal leg 1 and a longitudinal side of the first transverse leg 3. The first longitudinal leg 1 of the magnetic circuit as shown is located with its first end face on the permanent magnet 5 and with its second end face on the second transverse leg 4.

The first longitudinal leg 1 is widened on its first end face, which abuts against the permanent magnet 5, for example a ferrite magnet. In this manner, a permanent magnet with an enlarged surface area can be used and the coupling of magnetic flux into the first longitudinal leg 1 can be increased. The first longitudinal leg 1, for example, can be designed as an L-shape. In the example embodiment shown, the width of the first longitudinal leg 1 increases continuously into an end section. The first longitudinal leg 1 thus has a wedge-shaped extension in its end section on its longitudinal side facing the second longitudinal leg 2.

The two transverse legs 3, 4 are of the same design, each with one end face facing towards the second longitudinal leg 2 and one longitudinal side facing towards the first longitudinal leg 1. In the embodiment shown the first longitudinal leg 1 is therefore shorter than the second longitudinal leg 2. The transverse legs 3, 4 and the second longitudinal leg 2 can have the same width. The first longitudinal leg 1 can be wider than the second longitudinal leg 2 and the two transverse legs 3, 4. For example, the transverse legs 3, 4 and the second longitudinal leg 2 can everywhere have a width that is less than two thirds of the minimum width of the first longitudinal leg 1; for example, the transverse legs 3, 4 and the second longitudinal leg 2 can have a width that is not more than half the width of a main section of the first longitudinal leg 1.

The interfaces with which the legs 1, 2, 3, 4 abut against each other, or against the permanent magnet 5, extend either in a longitudinal direction or in a transverse direction. In this manner the assembly of the magnetic core and the production of the individual legs 1, 2, 3 and 4 can be facilitated.

Figure 2:
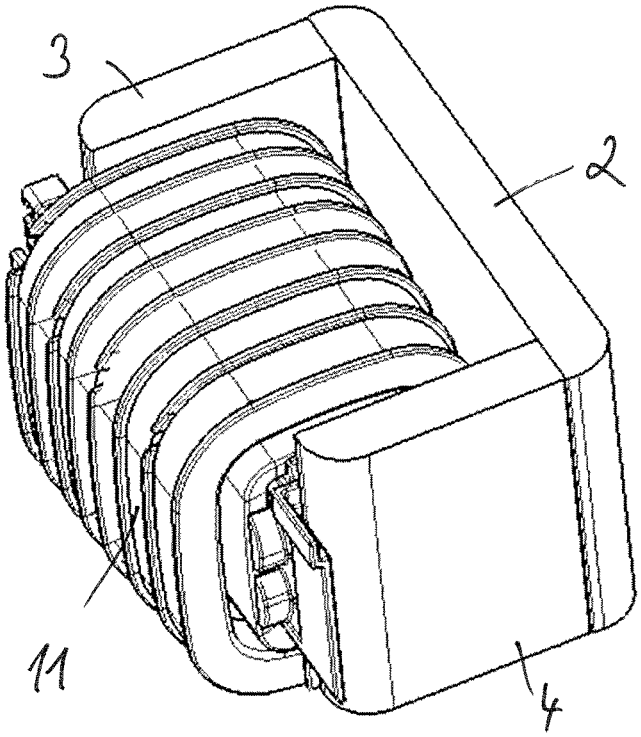
FIG. 2 shows an embodiment of a transformer with a magnetic core as in FIG. 1.
Figure 3:
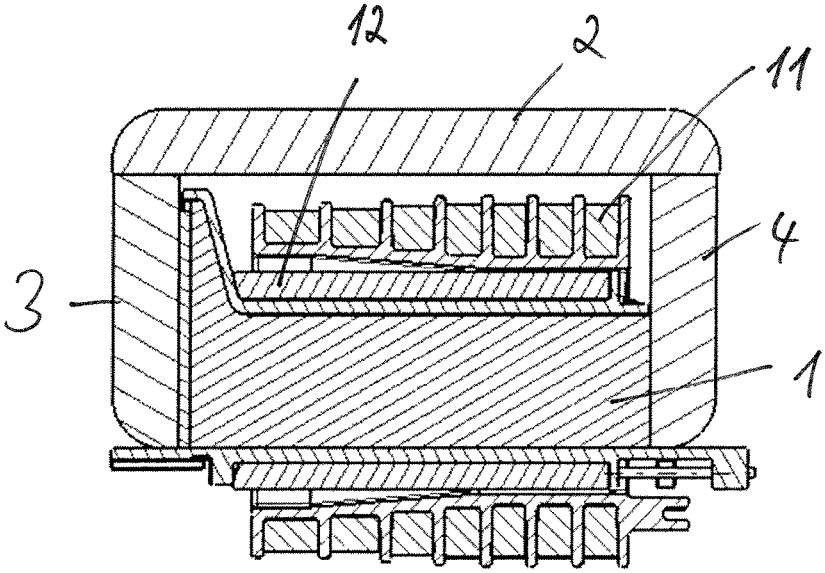
FIG. 3 shows a cross-sectional view through FIG. 2.

FIG. 2 shows in a side view, and FIG. 3 shows schematically in a cross-sectional view, a transformer in the form of an ignition coil, which contains a magnetic core as in FIG. 1. The second longitudinal leg 2 and the two transverse legs 3, 4 of the magnetic core are clearly visible. The first longitudinal leg 1 is surrounded by the primary windings 12 and secondary windings 11 of the transformer. In the embodiment shown, the secondary winding 11 is wound around the primary winding 12 as a chamber winding. However, ignition coils can also be implemented with an external primary winding.

Figure 4:
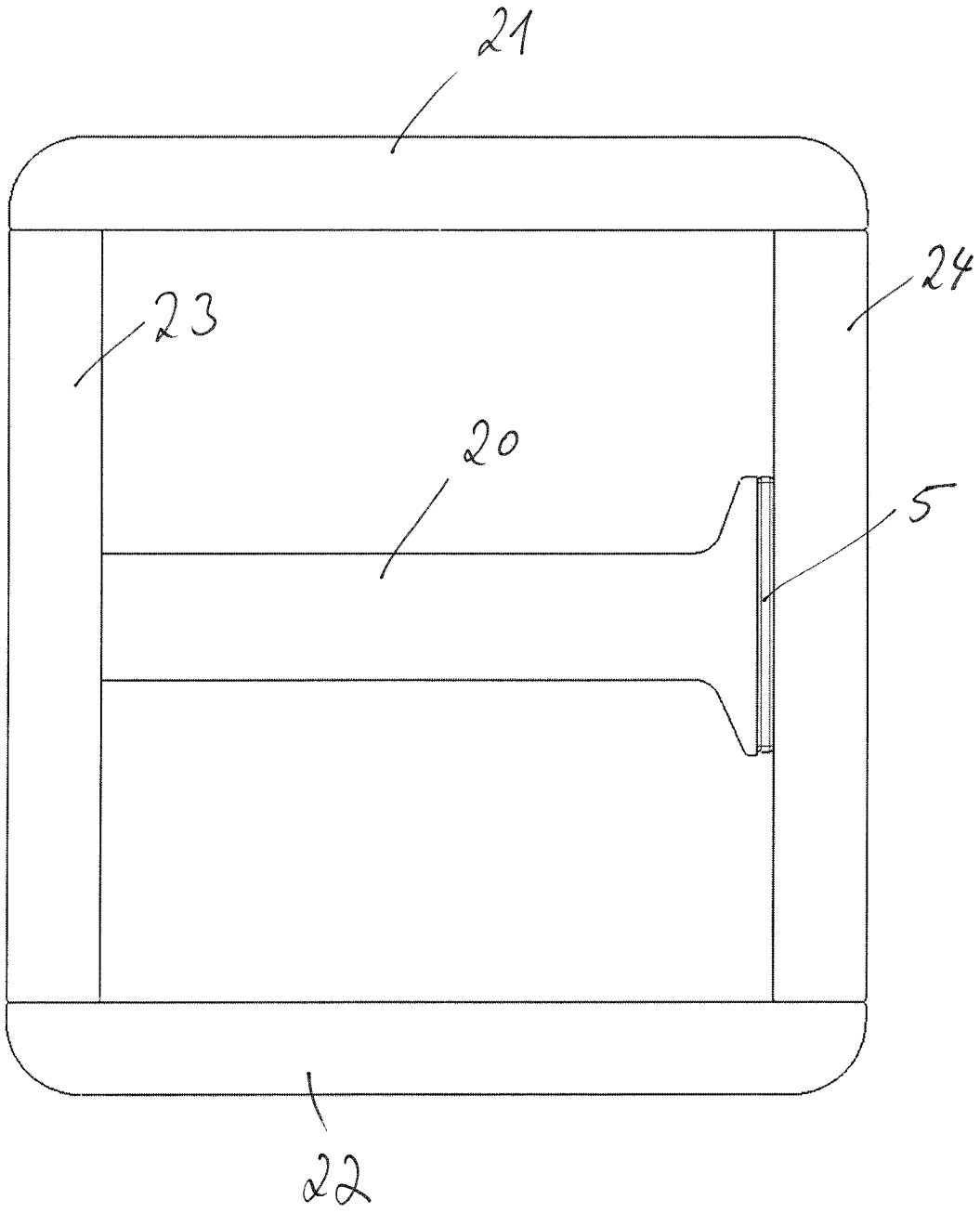
FIG. 4 shows a further embodiment of an inventive magnetic core.

FIG. 4 shows a further embodiment of a magnetic core for a transformer. This magnetic core contains a central longitudinal leg 20, outer longitudinal legs 21, 22 and two transverse legs 23, 24. Between the central longitudinal leg and the transverse leg 24 a permanent magnet 5, for example a ferrite magnet, is arranged. A first end face of the central longitudinal leg 20 thus abuts against the permanent magnet 5 and a second end face abuts against the transverse leg 23. The central longitudinal leg 20 has a widened cross-section in the form of a foot at its end facing towards the permanent magnet 5.

Figure 5:
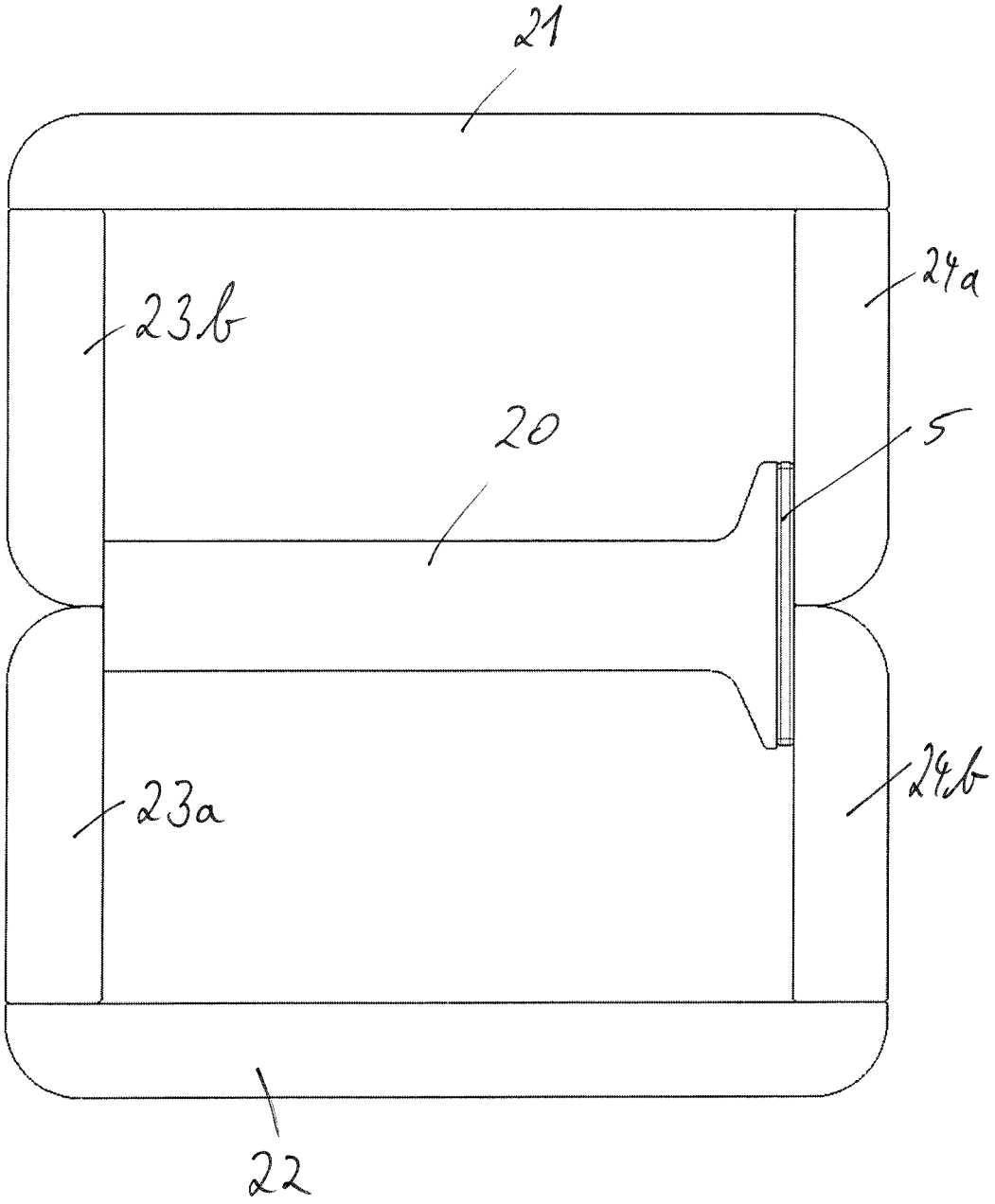
FIG. 5 shows a further embodiment of an inventive magnetic core.

FIG. 5 shows a modified embodiment, which differs from the embodiment shown in FIG. 3 only in the configuration of the transverse legs. Instead of continuous transverse legs, the magnetic core shown in FIG. 5 has divided transverse legs 23*a*, 23*b* and 24*a*, 24*b*, each of which extends from the central longitudinal leg 20 to one of the outer longitudinal legs 21, 22. In the region of the central longitudinal leg 20, the transverse legs 23, 24, or 23*a*, 23*b*, 24*a*, 24*b*, can be adapted to the magnetic flux as shown in FIG. 4, so that a rounded recess ensues towards the central longitudinal leg 20. In this manner, a weight saving can be achieved without any negative influence on the magnetic field.

Figure 6:
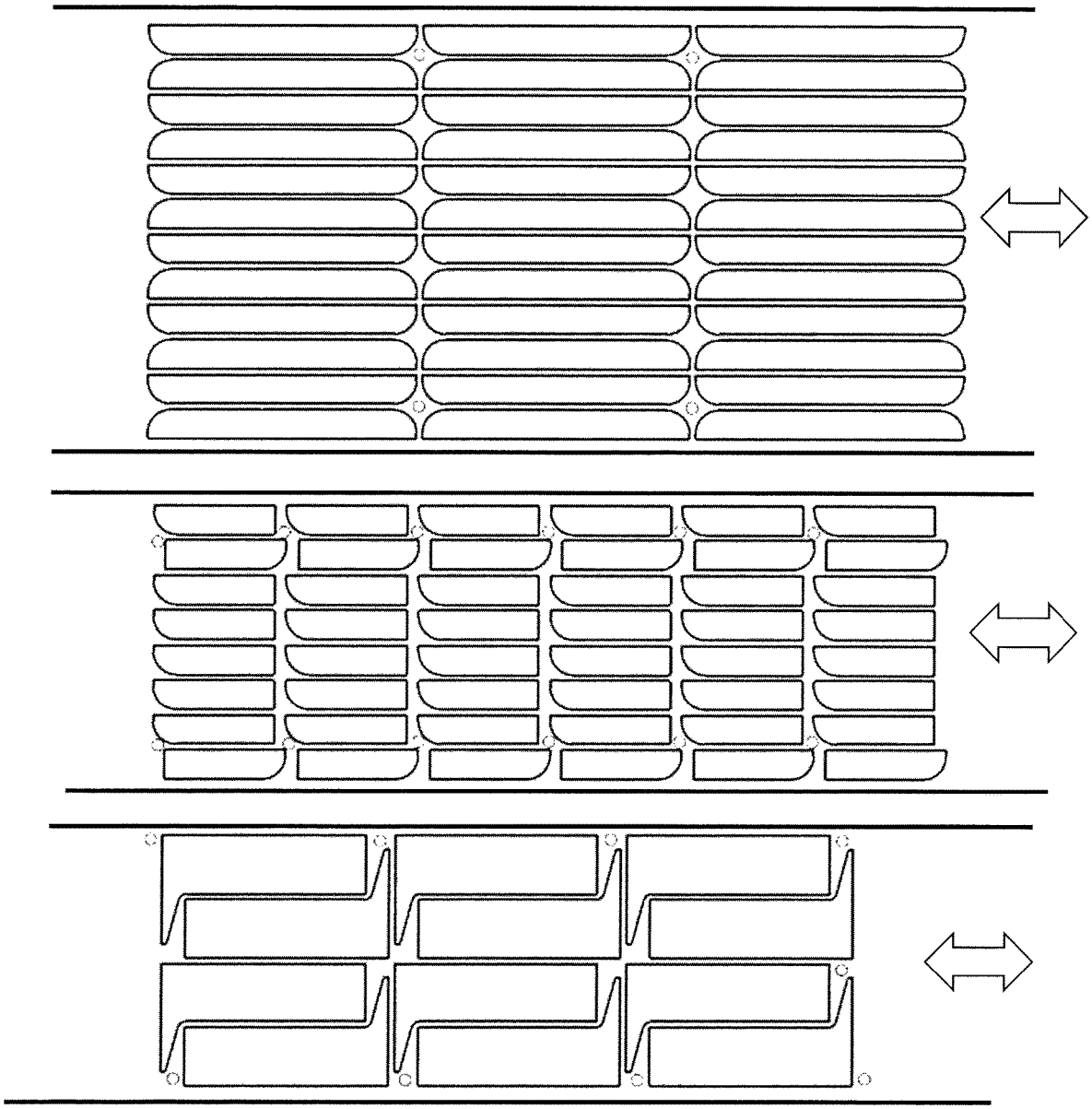
FIG. 6 shows sheet metal blanks for the legs of this magnetic core.

FIG. 6 shows how to cut out transformer blanks economically for the legs 1, 2, 3, 4 from a strip of transformer sheet, that is to say, how to utilize the transformer sheet efficiently and minimise waste. The blanks of transformer sheet are then layered to form a stack that forms one of the legs 1, 2, 3, 4. Transformer sheet is sometimes also referred to as electrical sheet or core lamination. Here these take the form of reinforced soft magnetic iron, for example iron reinforced with silicon.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Longitudinal leg
2 Longitudinal leg
3 Transverse leg
4 Transverse leg
5 Permanent magnet

What is claimed is:

1. A method of assembling a magnetic core for a transformer, comprising:

cutting sheet metal blanks from a transformer sheet;

stacking the sheet metal blanks to form a plurality of magnetic core segments, each of the plurality of magnetic core segments being formed by a separate sheet metal stack;

placing a permanent magnet at one of the magnetic core segments to thereby magnetize the one of the plurality of magnetic core segments by the permanent magnet; and subsequent to the step of placing the permanent magnet, forming the magnetic core by placing remaining magnetic core segments at the permanent magnet or against another of the plurality of magnetic core segments which is already magnetized by the permanent magnet wherein the magnetic core includes a plurality of legs and each magnetic core segment forms no more than one leg of the magnetic core.

2. The method according to claim 1, wherein the permanent magnet is a ferrite magnet.

3. The method according to claim 1, wherein a first end face of a first longitudinal leg of the magnetic core contacts the permanent magnet, and a second end face of the first longitudinal leg contacts a transverse leg of the magnetic core.

4. The method according to claim 3, wherein a longitudinal side of a second longitudinal leg contacts an end face of the two transverse legs.

5. The method of claim 1 wherein the plurality of legs includes a plurality of transversely extending legs and a plurality of longitudinally extending legs.

6. The method of claim 1 wherein interfaces between adjacent legs of the magnetic core extend either transversely or longitudinally.

7. The method of claim 1 wherein the plurality of legs includes three longitudinally extending legs and two transversely extending legs, each of the longitudinally extending legs being defined by a separate core segment and each of the transversely extending legs being defined by two separate core segments.

8. The method according to claim 7, wherein each of the core segments defining the transverse legs engages a central one of the longitudinal legs and has a rounded corner, each of the rounded corners of the core segments defining the transverse legs defining an edge that terminates at the central one of the longitudinal legs.

9. The method of claim 1 further comprising a step of subjecting the transformer to a temperature which exceeds the Curie temperature of the permanent magnet.

10. A method of assembling a magnetic core for a transformer, comprising:

cutting sheet metal blanks from a transformer sheet;

stacking the sheet metal blanks to form magnetic core segments;

placing a permanent magnet at one of the magnetic core segments to thereby magnetize the one magnetic core segment by the permanent magnet;

subsequent to the step of placing the permanent magnet, forming the magnetic core by placing remaining magnetic core segments at the permanent magnet or against another of the magnetic core segments which is already magnetized by the permanent magnet; and subjecting the transformer to a temperature which exceeds the Curie temperature of the permanent magnet.

11. The method according to claim 10, wherein the permanent magnet is a ferrite magnet.

* * * * *